United States Patent [19]

Mehta et al.

[11] 4,211,261

[45] Jul. 8, 1980

[54] FABRICS FOR PROTECTIVE GARMENTS HAVING STRANDS OF REFLECTIVE MATERIALS

[75] Inventors: Parvez Mehta, Leeds; Anthony M. Warnes, Ilkley, both of England

[73] Assignee: I.W.S. Nominee Company Limited, London, England

[21] Appl. No.: 829,251

[22] Filed: Aug. 30, 1977

[30] Foreign Application Priority Data

Sep. 2, 1976 [GB] United Kingdom ..... 36448/76

[51] Int. Cl.[2] ..... D03D 15/12; D04B 21/00

[52] U.S. Cl. ..... 139/425 R; 139/420 R; 2/2; 2/81; 66/202

[58] Field of Search ..... 139/425 R, 420 R, 426 R, 139/408, 413, 414, 426; 66/202; 2/2, 81; 428/256–259

[56] References Cited

U.S. PATENT DOCUMENTS

| | | | |
|---|---|---|---|
| 1,983,617 | 12/1934 | Ladon | 139/425 R |
| 2,204,094 | 6/1940 | Meier | 139/413 |
| 2,627,072 | 2/1953 | Frommelt et al. | 2/2 |
| 3,002,252 | 10/1961 | Scheyer | 139/425 R |
| 3,069,746 | 12/1962 | Scharf | 139/425 R |
| 3,806,959 | 4/1974 | Gross | 66/202 |
| 4,001,477 | 1/1977 | Economy et al. | 139/420 R |

FOREIGN PATENT DOCUMENTS

| | | | |
|---|---|---|---|
| 51-49970 | 10/1974 | Japan | 139/420 R |
| 6705006 | 10/1967 | Netherlands | 139/425 R |
| 292299 | 6/1928 | United Kingdom | 2/81 |
| 1379753 | 1/1975 | United Kingdom | 66/202 |

*Primary Examiner*—James Kee Chi

*Attorney, Agent, or Firm*—Harold L. Stowell

[57] ABSTRACT

Protective fabrics having a reflective surface are made of textile yarns, for example of wool, intermeshed with strands of reflective material, for example a metallized plastics film, a major proportion of the textile yarns being present in one face of the fabric and a major proportion of the reflective strands in the other. The fabric may be woven, for example on a double beam loom, or knitted, as on a double jersey machine. ,he preferred reflective strand is a laminate of aluminium between two polyester films, split into widths between 0.3 and 0.8 mm.

9 Claims, 8 Drawing Figures

KEY :- ▬ = ALUMINIUM TAPE

KNITTED FABRIC OF TEXTILE YARNS AND STRANDS OF REFLECTIVE MATERIAL

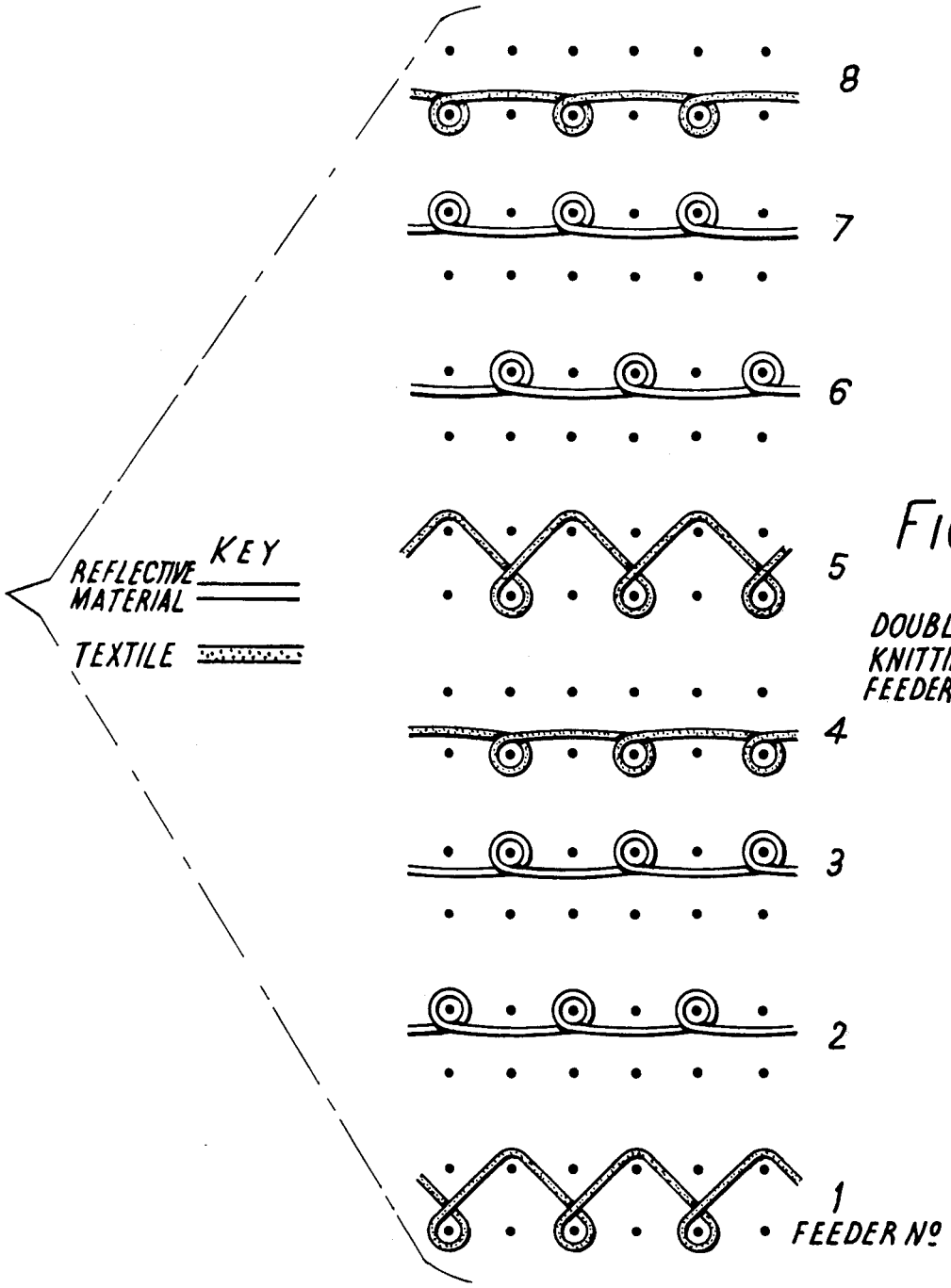
FIG. 6
DOUBLE JERSEY KNITTING MACHINE FEEDER DIAGRAM
FIG. 7
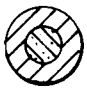
SURFACE METALLISED STRAND
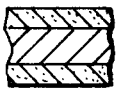
FIG. 8
ALUMINIUM LAMINATED BETWEEN POLYESTER

FABRICS FOR PROTECTIVE GARMENTS HAVING STRANDS OF REFLECTIVE MATERIALS

This invention relates to protective fabrics and more particularly to fabrics having a reflective surface.

Protective garments for persons working in close proximity to fire and other heat sources often have reflective outer surfaces to reflect as large a portion as possible of the incident radiant heat. Two methods have been proposed for producing such fabrics. The first involves laminating a sheet of bright metal to a fabric using standard lamination techniques; the second method is to metallise one surface of a fabric by vapour deposition of a suitable metal, e.g. aluminium.

The fabrics produced by both of these prior techniques suffer from various defects, the principal of these being stiffness and lack of permeability. Thus both types of fabric are uncomfortable to wear for long periods. Since garments of protective fabrics have to be worn by a wide variety of people, e.g. metal workers, furnacemen, ship-builders, firemen and welders in appropriate conditions, it would obviously be desirable to have a protective fabric from which garments could be made that would be comfortable over extended periods of wear.

The invention seeks to provide a fabric which is permeable, is less stiff than the above-described prior fabrics, and may be made in lighter weights without losing effectiveness of protection.

According to the invention there is provided a fabric composed of textile yarns intermeshed with strands of reflective materials, in which a major proportion of the textile yarns are present in one face of the fabric and a major proportion of the reflective strands are present in the other face of the fabric.

The fabric may be produced by weaving or knitting. For example, double beam weaving or weaving to obtain a double-faced fabric may be employed or the fabric may be knitted on a double jersey knitting machine, preferably interlock gated. However, for most end-uses a woven fabric is preferred, and therefore we prefer to make the fabric using a double beam weaving method.

The textile yarns used affect the comfort, appearance and fire resistance of the finished fabric. Any known textile yarn, filament or strand may be employed, for example using polyamide, polyester, acrylic, regenerated cellulosic, polyalkylene, or vinyl filaments or fibres. Natural fibres such as cotton or linen may also be employed, but it is preferred to use yarns of keratinous fibres, especially wool, on account of their superior comfort, drape and flame-retardant properties.

For the reflective strand, metal or metallised yarns, filaments or strands may be used, for example stainless steel or copper fibres. However it is preferred to use aluminised threads of cotton or polyester, and in particular strands produced by sandwiching a film (typically 1 or 2 microns thick) of aluminium between two polyester films, and splitting the laminate into tapes of any desired width. Tapes of width between 0.3 and 0.8 mm have been found optimum for most purposes; below 0.3 mm the strength of the tape is too low to withstand the stresses of weaving or knitting; above 0.8 mm it is too wide and the cloth produced is unsatisfactory, e.g. the tapes tend to buckle at the interlacings of the weave. About 0.4 mm is the preferred thickness.

The woven fabric may be made using reflective strands in the weft only but for an especially high degree of reflectance we prefer to use reflective strands in both the warp and the weft.

As mentioned previously, it is preferred to use wool yarns as the textile component because, inter alia, of wool's natural flame retardance. This may be improved even further by treatment with anionic complexes of titanium or zirconium according to the process of our U.K. Patent Nos. 1,372,694 and 1,379,752. It is preferred to carry out either of these processes on the wool yarns before weaving into the fabric of the invention to prevent any possible adverse effect on the reflective component of the fabric.

In the drawings:

FIG. 6 is a feeder diagram for a double jersey knitting machine.

FIG. 7 is a cross section of a surface metallised strand.

FIG. 8 is a cross section of an aluminium laminated between polyster.

Figure 1:
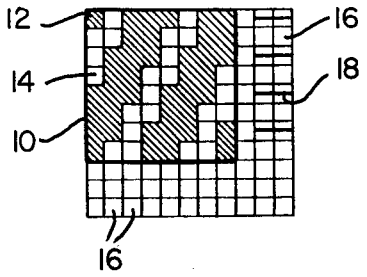
FIGS. 1 to 4 are weaving designs of four fabrics constructed according to the invention.
Figure 2:
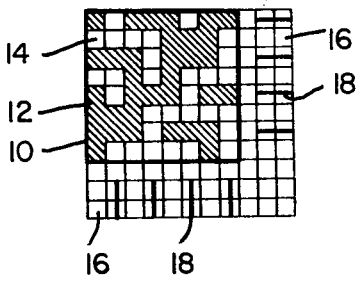
Figure 3:
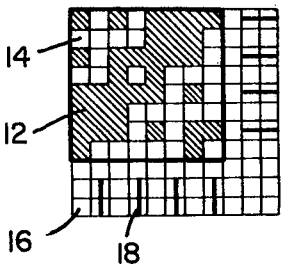
Figure 4:
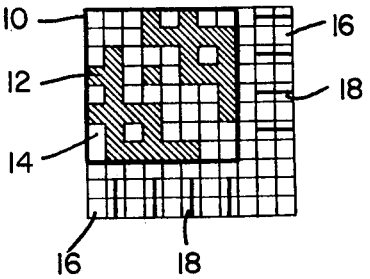
Figure 5:
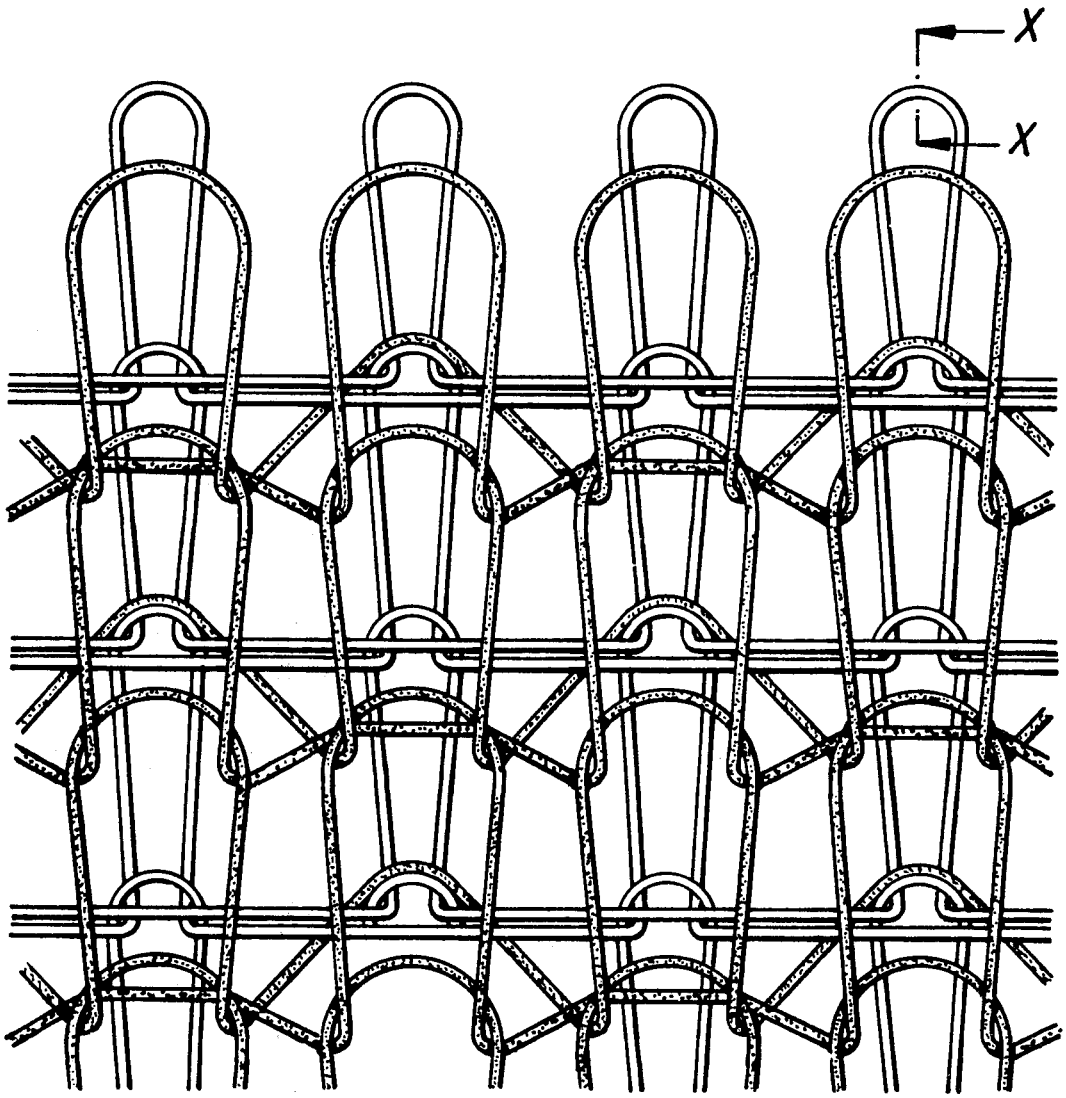
FIG. 5 is an enlarged somewhat diagrammatic view of a knitted fabric of textile yarns and strands of reflective material.

Referring to the drawings, as is well understood in the art, the 8×8 square boxes 10 boldly outlined show the pattern in which the fabric is woven. Shaded squares 12 indicate that the warp yarn passes over the weft yarn; and blank squares 14 indicate that the weft yarn passes over the warp yarn. In FIG. 1 the blank squares below the box 10 indicate that all eight warp yarns in the pattern unit are textile yarns 16. The weft yarns are indicated to the right of the box 10 and it can be seen that in FIG. 1 alternate weft yarns are textile yarns 16 (blank squares) and aluminium yarns 18 (lined squares). In FIGS. 2 to 4 there are alternate aluminium yarns 18 in the wool also.

The following examples, described with reference to the accompanying drawings showing four fabric patterns, will illustrate the invention further.

EXAMPLE 1—Aluminium inweft only

Since high strength and extension is required in the warp thread for satisfactory weaving, a fabric using aluminium in the weft only was tried to ascertain whether it would give substantial thermal protection.

2/32's wool yarn was used in the warp and in alternate weft picks with 0.37 mm aluminium tape. The fabric was a 2×2 twill with a weft back and is shown in FIG. 1.

Protection against thermal radiation was measured by a method similar to the British Standard 3791 in which a fabric sample is held in an assembly to measure the temperature of the back of the fabric when placed 20 cm away from a gas-fired radiant panel at a black body equivalent temperature of 660° C. The results are given in TPI Thermal Protection Index (radiation) which is a number equal to the time in seconds before the temperature of the back surface of the sample rises 25° C.

The TPI (radiation) of the experimental fabric was 17 compared to the TPI (radiation) of a standard commercial aluminised wool laminate of 34. This result, although superior to material containing no metal strands, could be improved by using aluminium tape in both warp and weft.

EXAMPLES 2 and 3—Aluminium in warp and in weft

To increase the heat reflective cover of the face of the fabric, aluminium tape was used both in the warp and in the weft. Two types of design were investigated. FIG. 2 shows a plain back structure and FIG. 3 a twill back structure. FIG. 4 shows the reverse face of FIG. 3.

The plain back structure was lighter in weight and was thinner than the twill back structure. The TPI (radiation) values for these two fabrics were 34 and 45 for the plain and the twill back structures respectively. (The TPI of laminated aluminised fabric 420 g.m.$^{-2}$ used as a standard was 37). Fabric details are given in Table I.

TABLE I

| Fabric Details | |
|---|---|
| Wool Yarn | R55 tex/2 (2/32's worsted) |
| Aluminum Tape | R26 tex (0.37 mm) |
| Reed Setting | 36 inch |
| Ends/inch | 120 } Alternate wool and aluminium strands |
| Picks/inch | 100 } Alternate wool and aluminium strands |
| Fabric width | 33.5 inch |
| Fabric Weight | 360 g.m.$^{-2}$ |
| Blend composition | 68% wool/32% Aluminium |

The woven fabric does not require wet finishing and the only finishing treatment envisaged is a demi-decating process under high wrapper tension.

Besides the thermal protective index (radiation) tests reported above, the fabrics were tested for snagging on the I.C.I. Mace Test and for dimensional stability of the fabric using a "Cubex" test washing machine (15 minute agitation time in 15 liters of phosphate buffer solution at pH 7)

The snag rating was 4 (5 is excellent) and the fabric shrinkage was less than 3% in any direction.

We claim:

1. A protective, reflective dual ply fabric having radiant heat reflective properties for use in construction of protective garments for persons working in close proximity to fire and other heat sources composed of textile yarns intermeshed with strands of heat reflective and protective materials, in which a major proportion of one face of the dual ply fabric is composed of the textile yarns and a major proportion of the other face of the dual ply fabric is composed of the heat reflective and protective strands.

2. A fabric according to claim 1 which is knitted on a double jersey knitting machine.

3. A fabric according to claim 1 which is woven by double beam weaving.

4. A fabric according to claim 1, in which the heat reflective and protective strand is a metallized strand of cotton or polyester.

5. A fabric according to claim 4 in which the heat reflective and protective strand is a laminate of aluminum between two polyester films, split to the desired width.

6. A fabric according to claim 5 in which the heat reflective and protective strand has a width between 0.3 and 0.8 mm.

7. A fabric according to claim 1 which is a woven fabric having heat reflective and protective strands in both the warp and the weft.

8. A fabric according to claim 1 wherein the textile yarns comprise keratinous fibres.

9. A fabric according to claim 8 in which the textile yarns are treated with anionic complexes of titanium or zirconium.

* * * * *